US007089886B2

(12) United States Patent
Thoma

(10) Patent No.: US 7,089,886 B2
(45) Date of Patent: Aug. 15, 2006

(54) APPARATUS AND METHOD FOR HEATING FLUIDS

(76) Inventor: Christian Helmut Thoma, The Court House, La Grande Route Des Sablons, Grouville, Jersey (VG) JE3 9FG ( * ) Notice: Subject to any disclaimer, the term of this patent is extended or adjusted under 35 U.S.C. 154(b) by 97 days.

(21) Appl. No.: 10/814,189

(22) Filed: Apr. 1, 2004

(65) Prior Publication Data

US 2004/0213668 A1 Oct. 28, 2004

Related U.S. Application Data

(60) Provisional application No. 60/459,365, filed on Apr. 2, 2003.

(51) Int. Cl.
*F22B 3/06* (2006.01)

(52) U.S. Cl. ..... 122/26

(58) Field of Classification Search ..... 122/26; 237/12.3 R; 126/247
See application file for complete search history.

(56) References Cited

U.S. PATENT DOCUMENTS

| | | | | |
|---|---|---|---|---|
| 4,424,797 | A | 1/1984 | Perkins | |
| 5,188,090 | A | 2/1993 | Griggs | |
| 5,392,737 | A | 2/1995 | Newman, Sr. et al. | |
| 5,957,122 | A * | 9/1999 | Griggs | 126/247 |
| 6,386,751 | B1 | 5/2002 | Wootan et al. | |
| 6,595,759 | B1 * | 7/2003 | Crosta et al. | 417/63 |
| 6,910,448 | B1 * | 6/2005 | Thoma | 122/26 |

FOREIGN PATENT DOCUMENTS

| | | |
|---|---|---|
| GB | 1 217 959 | 1/1971 |
| GB | 2 143 632 | 2/1985 |

* cited by examiner

*Primary Examiner*—Gregory Wilson
(74) *Attorney, Agent, or Firm*—Young & Thompson

(57) ABSTRACT

An apparatus for heating a liquid comprising a housing having an internal chamber and a rotor disposed in said chamber. A drive shaft rotatably supported in the housing and extending into said chamber for imparting mechanical energy to the rotor. The rotor having a generally hemispherically shaped form and provided with a series of openings. A fluid intake passage in said housing preferably arranged to be nearer the rotational axis of the rotor and a fluid exit passage preferably positioned radially outwardly of said rotor.

16 Claims, 6 Drawing Sheets

APPARATUS AND METHOD FOR HEATING FLUIDS

BACKGROUND OF THE INVENTION

The invention relates generally to the heating of liquids, and specifically to those devices wherein rotating elements are employed to generate heat in the liquid passing through them. Devices of this type can be usefully employed in applications requiring a hot water supply, for instance in the home, or by incorporation within a heating system adapted to heat air in a building residence. Furthermore, a cheap portable steam generator could be useful for domestic applications such as the removal of winter salt from the underside of vehicles, or the cleaning of fungal coated paving stones in place of the more erosive method by high-pressure water jet.

Of the various configurations that have been tried in the past, types employing rotors or other rotating members are known, one being the Perkins liquid heating apparatus disclosed in U.S. Pat. No. 4,424,797. Perkins employs a rotating cylindrical rotor inside a static housing and where fluid entering at one end of the housing navigates through the annular clearance existing between the rotor and the housing to exit the housing at the opposite end. The fluid is arranged to navigate this annular clearance between static and non-static fluid boundary guiding surfaces, and Perkins relies principally on the shearing effect in the liquid, causing it to heat up.

An example of a frictional method for producing heat for warming a fluid is the Newman apparatus disclosed in U.S. Pat. No. 5,392,737. Newman employs conical friction surfaces in order to generate heat, the generated heat passing into a fluid reservoir surrounding the internal elements of the device, and where the friction surfaces are engaged together by a spring and adjustment in the compression of the spring controls the amount of frictional rubbing that takes place.

Such prior attempts at producing heat have suffered for a variety of reasons, for instance, poor performance during operation, and the requirement of complicated and expensive components. Scale build-up is another cost factor should subsequent tear down and refurbishment be then needed. Similarly, because friction materials eventually wear out, they must from time-to-time be replaced.

A modem day successor to Perkins is shown in U.S. Pat. No. 5,188,090 to James Griggs. Like Perkins, the Griggs machine employs a rotating cylindrical rotor inside a static housing and where fluid entering at one end of the housing navigates past the annular clearance existing between the rotor and the housing to exit the housing at the opposite end. The device of Griggs has been demonstrated to be an effective apparatus for the heating of water and is unusual in that it employs a number of surface irregularities on the cylindrical surface of the rotor. Such surface irregularities on the rotor seem to produce an effect quite different than the forementioned fluid shearing of the Perkins machine, and which Griggs calls hydrodynamically induced cavitation. Also known as the phenomena of water hammer in pipes, the ability of being able to create harmless cavitation implosions inside a machine without causing the premature destruction of the machine is paramount. The Griggs machine may well operate with some of the developed heat through the effects of fluid shear, but nonetheless, his machine has been shown to work well and is currently known to be used in a number of applications.

An important consideration concerning machinery operating at relatively high temperature conditions is the protection of bearings and seals from premature wear. In the case of Griggs, separate detachable bearing/seal units are employed which are externally attached to the main body of the housing. As a result of such spacing, the bearing and seal members operate in a cooler environment than they otherwise might do if placed directly in the main housing body. Even so, while on the one hand such detachable bearing/seal units may well provide better performance, on the other hand, their inclusion may increase expense due to the additional complication with respect of the construction of the housing. Although by no means essential, it would be advantageous if, such bearings and seals, could be deployed in the main body of the housing.

Whereas Perkins relies on an impeller to ensure there is always a steady and continuous supply of fluid being drawn through his machine, no such impeller is included in the machine of Griggs. As a result, the Griggs machine is less flexible as it can only perform by relying on a sufficient pressure head of fluid at the input, ie. mains water pressure, or a sufficient head of pressure from above situated holding tank, in order for sufficient fluid is able to make the journey through the annular clearance between rotor and housing. In neither Griggs or Perkins is the fluid itself propelled through the clearance by the action of the rotor rotation.

There therefore is a need for a new solution for an improved mechanical fluid heater, and in-particular where the shape of the rotor operating in a similiarly shaped cavity formed by the surrounding housing causes the fluid on entering the cavity at or near to the rotational axis of the rotor to be displaced in a generally spiral trajectory and past, when incorporated on the surfaces of the rotor, a multitude of cavitation implosion zones, before reaching the periphery of the rotor. With a rotor operating as a primative form of fluid pump, less reliance is placed on having a sufficiently large head of fluid pressure at the inlet to the device.

The present invention seeks to alleviate or overcome some or all of the above mentioned disadvantages of earlier machines, in a device that is relatively simple to implement of less bulk and preferably with fewer component parts, and/or requiring fewer machining operations. The rotating member according to the invention has the potential to perform with a higher efficiency over a wider operating band, relative to the Griggs or Perkins machines because of the compactness of its rotor. As the rotor is relatively short in axial length but greater in its radial dimension, while still providing the interior volume space for deploying a series of cavitation implosion zones when included, the relative mass of the rotor as compared to Griggs or Perkins is lower allowing operation at high rotational speeds. There is a need for a new fluid heat generating device employing a rotor that can be compactly packaged in the housing, preferably avoiding the detachable bearing/seal units of Griggs for reasons of economy, operating at high speed to displaced fluid, preferably from the central intake to a peripheral exit.

SUMMARY OF THE INVENTION

A principal object of the present invention is to provide a novel form of water heater steam generator apparatus capable of producing heat at a high yield with reference to the energy input. It is a still further object of the invention to provide a method for doing so.

It is a preferred feature of the invention that the entry point for the fluid entering the machine is central or close to the center axis of the drive shaft, preferably coincident with the axis of rotation of the rotor. The fluid entering the device on arriving at central chamber is propelled through fluid passage gap region in a generally spiral path towards the peripheral outlet to exit the machine. A proportion of the fluid entering the device may also be propelled through a further fluid passage gap region for additional heating of the fluid by the rotor. One fluid passage gap regions lies between the housing interior and the hemi-spherically shaped exterior surface portion of the rotor and the other fluid passage gap region lies between the housing interior and the end face surface portion of the rotor. Both surfaces may be of generally smooth appearance for the generation of heat by fluid shear like Perkins, or one or both surfaces may have a a number openings or depressions for the generation of heat by cavitation like Griggs.

With the latter, such openings or cavitation inducing depression zones incorporated on one or both surface portions of the hemi-spherical rotor, the fluid riding over each opening or depression zone in turn, it is squeezed and expanded by the vacuum pressure conditions occuring in the zone, and the condition of cavitation together with accompanying shock wave behaviour, as the fluid traverses across the surface portion or portion, liberates a release of heat energy into the fluid. Although natural forces such as cavitation vortices are known to occur in nature, the forces to be generated in the present invention are usually viewed as an undesirable consequence in man-made appliances. Such destructive forces, in the form of cavitation bubbles of vacuum pressure, are purposely arranged to implode within locations in the device where they can do no destructive harm to the structure or material integrity of the machine. In this respect, this invention discloses the preferred use of openings or depression zones in the form of a plurality of circular arrays of holes, preferably of increasing number and collective volumetric size with respect to the expanding radial dimension of the rotor taken from its rotation axis towards broadening the occurance in the number and range of resonant frequencies for an additional influence in the formation of cavitation bubbles. A spiral array of holes may be deployed and the shape of the holes modified to have bellmouthed edges.

It is therefore an aspect of this invention to be able to rapidly and successively alter and disrupt the spiral path of fluid flowing between the rotating and stationary elements in the passage gap region or regions as it passes across these depressions which during operation of the device may become emptied or largely emply vessels of vaccum pressure, and where the deployment of openings or depression zones in the rotating rotor act in diverting a quantity of the passing fluid over the surafce of the rotor into these openings or depression zones for the formation of cavitation vortices inside these voids and their attendant shock waves and water hammer effects in the fluid. The fluid once subjected to water hammer returns back to the fluid passage gap region with an increase in temperature and this continues in a continuous process until the fluid eventually reaches the periphery of the rotor from where it is directed to exit the device. As such, each of said openings or depression zones becomes in effect individual heating chambers for the device.

It is a further feature of this invention to keep the rotor as compact as possible without sacificing internal volume for the deployment of the cavitation implosion zones, when required. For instance, a hemi-spherical rotor, being naturally relatively short in axial length but greater in its radial dimension, the potential depth available for the deployment of such forming cavitation implosion zones is greater than would be normal be the case with a rotor shaped like a flat disc. Furthermore, the flat surface of the hemi-spherical rotor can also, when desired, be used to incorporate a further and quite separate deployment of cavitation implosion zones just like the rotor shaped like a flat disc would have.

It is also a preferred feature of the invention to mimimize the risk of bearing and seal failure. In this respect, the examples show that the positioning of the fluid inlet axially adjacent the inner end of the drive shaft has the principle advantage that the support bearing receives a copious supply of cooling fluid, while also removing the requirement for any type of seal member to be located between the housing and shaft at this end of the device. The transmission of power to the device without any direct mechanical connection would remove the requirements for a seal member at the opposite end of the device. However, when such a seal member is to be deployed, the fluid passages can be adapted to provide the seal with sufficient fluid for cooling/lubrication purposes.

In one form thereof, the invention is embodied as an apparatus for the heating of a liquid such as water, comprising a static housing having a main chamber and at least one fluid inlet and at least one fluid outlet in fluid communication with the internal chamber. Preferably, the fluid inlet and/or the fluid outlet are located in a static member such as the housing. The chamber of the housing contains a rotor in the form of at least one element and where the rotor element divides said chamber into first and second fluid passage gap regions and where rotation of the rotor causes fluid entering said inlet to be displaced into at least one of said first and second fluid passage gap regions. The rotor assembly is preferably driven by means of a drive shaft and where the drive shaft is supported by a pair of bearings disposed to each side of the rotor in the housing. Preferably, the rotor and drive shaft have a common axis of rotation. The rotor may be engaged to the drive shaft by means of a heat-shrink fit but other forms of drive means may be deployed such as for instance, splines. The fluid inlet is preferably disposed to lie closer to the axis of rotation than the fluid outlet. The rotor may have a smooth surface appearance to effect heating of the fluid through the action of fluid shear or, alternatively, by means of being provided with a plurality of openings facing towards at least one of said first and second passage gap regions, and in which case, heating is performed by the action of heat-generating cavitation.

Preferably mains water pressure or the source tank situated above the height of the device can be used to provide the device with water at the inlet connection.

While most embodiments here illustrated describe rotors having surface irregularities in the form of openings, the invention equally applies to rotors having a generally smooth surface appearance. Rotors without openings are less costly to manufacture and can be used for certain applications, operating somewhat in the fashion of Perkins, where the rise in temperature of the fluid occurs due to the shearing effect on the fluid as it passes the clearance between rotor and housing. Accordingly, it is a further object of the invention for the device to provide more flexibility for each particular application and dynamic operational condition, regardless whether the heat output is in the form of a liquid or vapour at various pressures.

Other and further important objects and advantages will become apparent from the disclosures set out in the following specification and accompanying drawings.

BRIEF DESCRIPTION OF THE DRAWING

The above mentioned and other novel features and objects of the invention, and the manner of attaining them, may be performed in various ways and will now be described by way of examples with reference to the accompanying drawings, in which.

These figures and the following detailed description disclose specific embodiments of the invention; however, it is to be understood that the inventive concept is not limited thereto since it may be incorporated in other forms.

DETAILED DESCRIPTION OF THE FIRST ILLUSTRATIVE EMBODIMENT OF THE INVENTION

Figure 1:
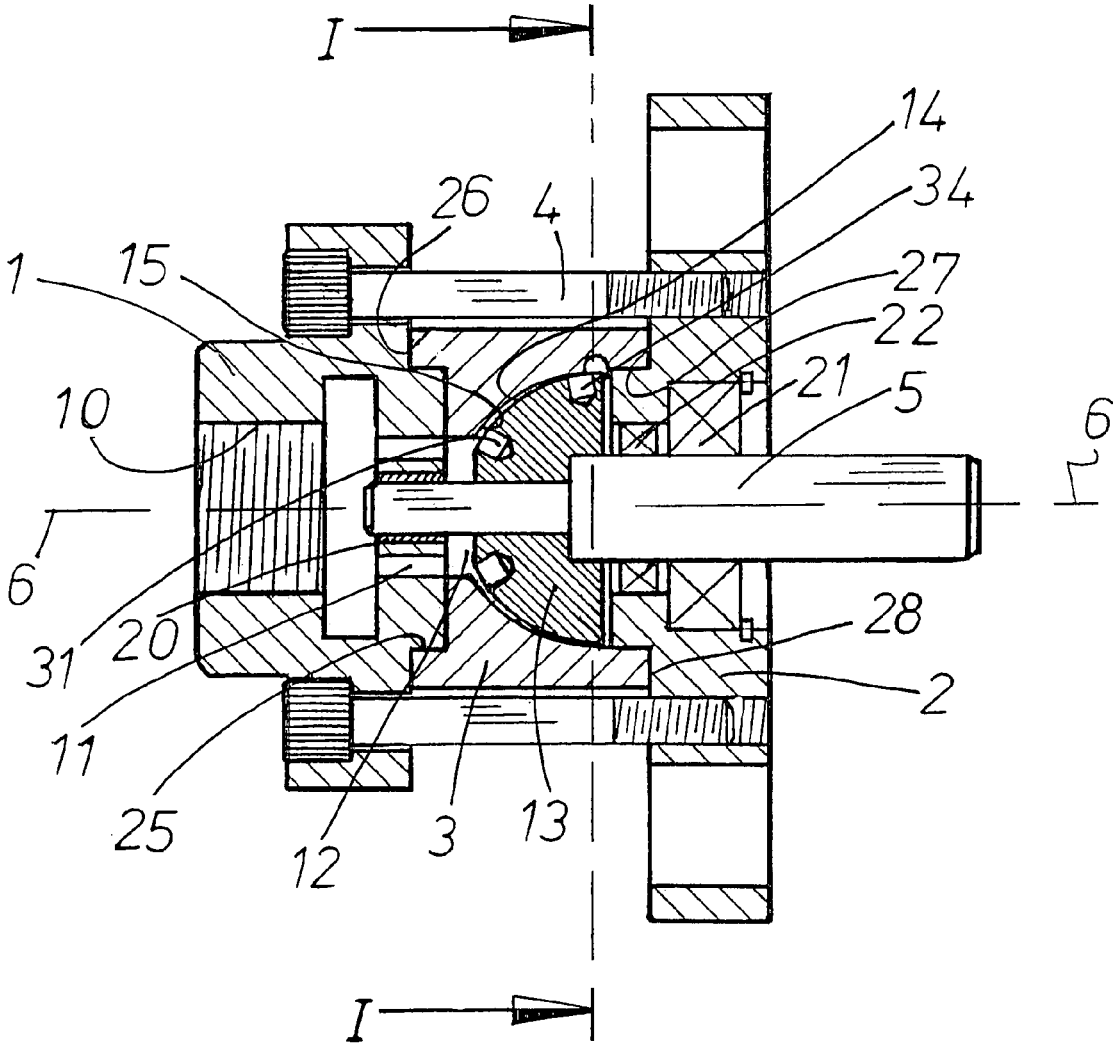
FIG. 1 is a longitudinal sectional view of a device in according to the first embodiment of the present invention.
Figure 2:
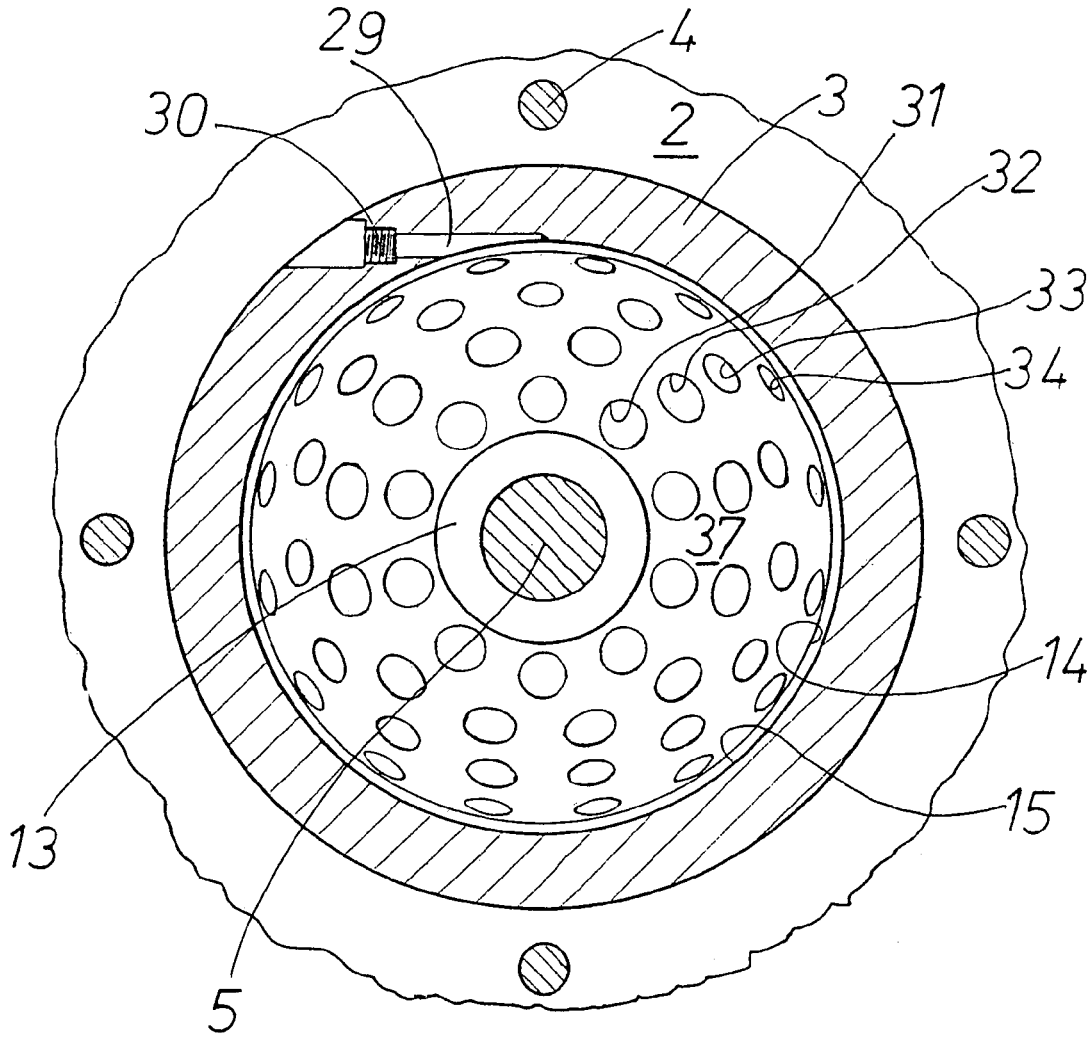
FIG. 2 is a transverse sectional view of the device taken along line I—I in FIG. 1.

Referring to FIGS. 1 and 2, the device here comprises a static housing structure having three elements : a rear housing member 1; a front housing member 2; a central housing member 3; and where four screws 4 are arranged to engage members 1, 2 together with member 3 held sandwiched inbetween. A drive shaft 5, having a longitudinal rotational axis 6, may be driven by a prime mover such as an electric motor. Housing member 1 is provided with fluid inlet 10 and one or more internal fluid ports 11. Ports 11 connect fluid inlet 10 to the interior space or main internal chamber 12 of the heat generating device. The chamber 12 is dimensioned in relation of the rotation axis 6 such that the maximum transverse radial distance is greater than the maximum longitudinal distance, and this space is largely occupied by a hemi-spherically shaped rotor 13.

As shown, rotor 13 is fixed to drive-shaft 5 by means of being a heat-shrink fit although other ways of providing a drive connection could alternatively be employed, for instance, shaft 5 having a male spline which is engaged into a female splined hole in the rotor 13.

Central housing element 3 is formed with a female hemi-spherical interior surface 15 and where hemi-spherical rotor 13 is spaced at a slight distance from surface 15 such that a slight gap or clearance exists between respective surfaces 14, 15. As shown, the gap size converges in relation to the increasing diameter of the rotor 13. However, the gap size height could alternatively be of a constant value over the entire distance or even be arranged to diverge in size in relation to the increasing rotor radial dimension. The centre point chosen by the creator of the device along axis 6 from which the respective hemispherical shapes are generated for the rotor 13, and surface 15 in housing member 3, and which in effect determines whether the the gap size height is of constant or variable value over the axially extending dimension for the rotor 13.

The gap size of height between these surfaces 14, 15 becomes in effect the working clearance of the device and may be referred to as a fluid passage gap region.

Drive-shaft 5 is supported in the housing by a pair of bearings, bearing 20 disposed in rear housing member 1 and bearing 21 disposed adjacent rotary seal 22 in front housing member 2. As bearing 20 is positioned close to the fluid entry connection 10, it remains largely unaffected by any heat build-up in other areas of the device.

Rear housing member 1 is provided with a register 25 on which one end 26 of housing central member 3 is engaged, and similarly, front housing member 2 has a similar register 27 on which the opposite end 28 of housing central member 3 is engaged. Sealant or some form of robust sealing device such as a gasket or "O" ring may be disposed between these joining surfaces to ensure there is no escape of fluid from the device.

Housing central member 3 is provided with a fluid exit 30 best seen in FIG. 2. Fluid exit 30 is in communication with interior space 12 by means of drilled passage 29 and preferably, the longitudinal axis of drilled passage 29 is offset from the central axis of the machine by at least the radial width of the rotor 13.

Rotor 13 is provided with a plurality of openings in the form of blind holes arranged in four rows, shown in FIG. 2 as rows 31, 32, 33 and 34. A short length of sealing land marked as 37 separates the holes.

In this rotor example, rows one to four contain ten, twelve, fifteen and sixteen holes, respectively, of the same diametric size. However if so desired, the numbers of holes per row as well as their diametric size may be varied to suit the parameters of the intended application, and the pattern of the holes changed from concentric rows to a spiral array of holes.

In operation, a prime mover for providing mechanical power to the device, for instance such as an electric motor, drives the device via drive shaft 5. Fluid entering the device through inlet 10 is directed through ports 11 to internal chamber 12 from where it is propelled by the rotating rotor 13, to follow the fluid passage gap region to reach drilled passage 29 and exit 30. During the transit of the fluid through the fluid passage gap region, it is subjected to heat-generating cavitation conditions caused by the rapidly moving rows of low pressure depression zones in and around the holes 31, 32, 33 and 34 on the rotor surface, resulting in heat energy being imparted to the fluid.

DETAILED DESCRIPTION OF THE SECOND EMBODIMENT OF THE INVENTION

Figure 4:
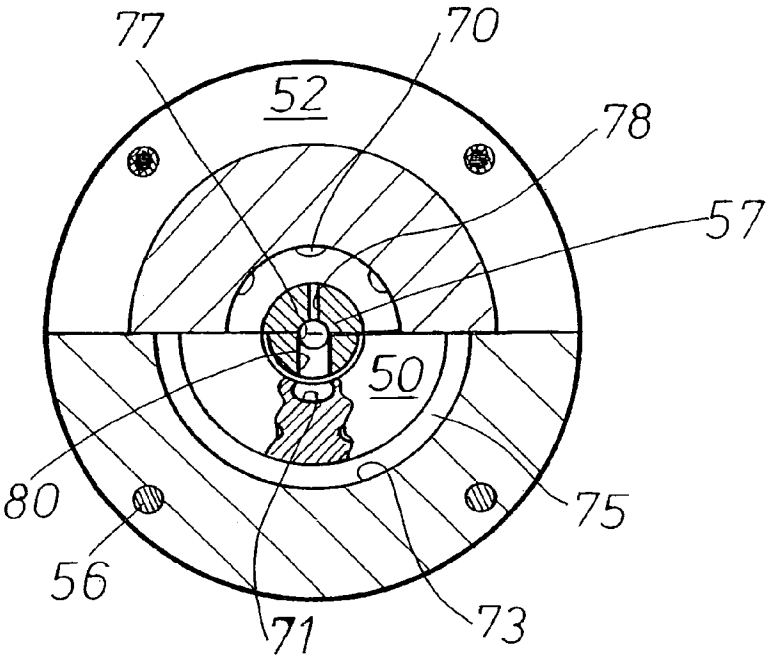
FIG. 4 is a transverse sectional view of the device taken along line II—II in FIG. 3.
Figure 3:
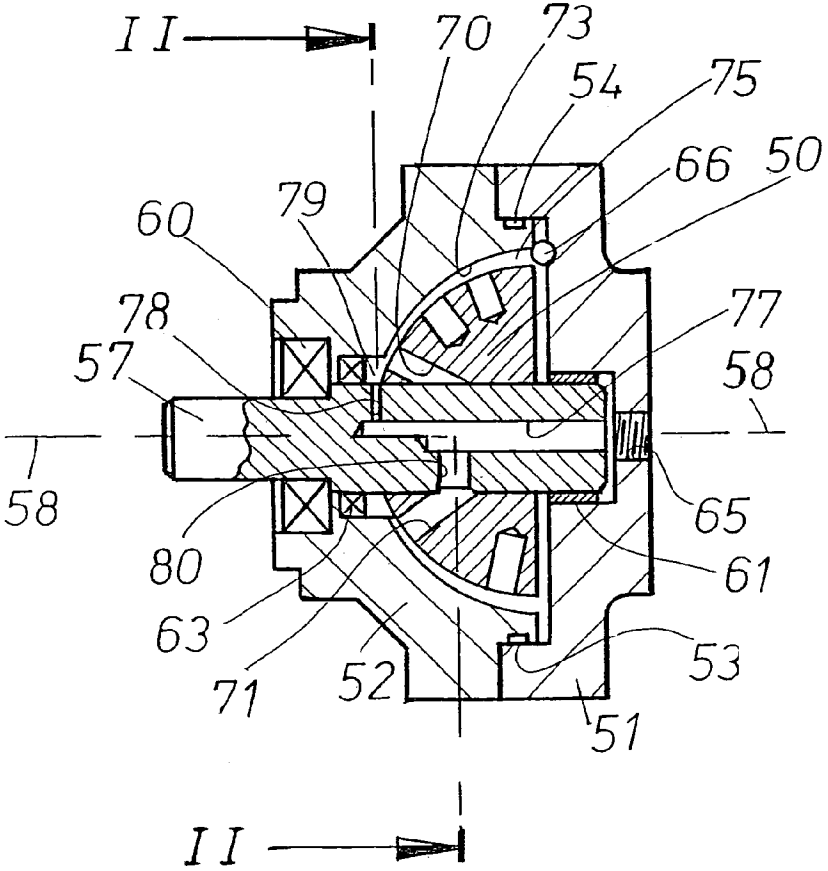
FIG. 3 is a longitudinal sectional view of a device in according to the second embodiment of the present invention.

Referring to FIGS. 3 and 4, the device here differs from the first embodiment in two main respects. Firstly, the housing structure surrounding the rotor 50 is comprised of two housing elements instead of three: a rear housing member 51 and a front housing member 52. Housing elements 51, 52 connect together on register 53 with seal 54 disposed at the interface, and a number of bolts 56 fasten housing elements 51, 52 together. A drive shaft 57 is supported in the housing by a pair of bearings, 60, 61, drive shaft 57 having a longitudinal axis of rotation denoted as 58. A seal such as a rotary lip seal 63 is seated in housing element 52 and where a pocket 79 separates seal 63 from rotor 50. A fluid port connection 65 fluid inlet 65 is disposed in housing element 51 which preferably for many application will serve as the fluid inlet, whereas housing element 51 includes passage 66 which preferably for many application will serve as the fluid exit. As is the case the first embodiment, fluid exit passage 66 lies at a greater radial distance from rotation axis 58 than the fluid inlet 65. However, it should be pointed out that for certain applications, especially when mains pressure is available, the device can be operated such that passage 66 becomes the fluid inlet and passage 65 the outlet.

Rotor 50 lies in the interior space between housing elements 51, 52, and is rotatably fixed to drive shaft 57. The rotor is provided with a plurality of openings such as openings shown as 70, 71. Opposing the openings lies the interior surface 73 of housing element 52 and the space between the rotor 50 and interior surface 73 is fluid passage gap region 75. The fluid entering the fluid passage gap region 75 is subjected to the cavitational effect emanating from the multitude of openings 70, 71 before exiting the device at passage outlet 66.

In this example, there are shown two different ways for the fluid to reach the entrance to the fluid passage gap region 75. As shown above axis line 58, here fluid entering the device at inlet 65 travels through holes 77, 79 in drive shaft 57 to reach pocket 79, and thereby seal 63 is particularly well provided for with lubricating/cooling fluid. The alternative way, shown below axis line 58, now fluid entering the device at inlet 65 travels through holes 77, 80 in drive shaft 57 is arranged to enter directly into first array of openings 63. Whether the fluid is arranged to enter the first array of openings directly, or indirectly or even in a combined way is a matter depending largely on the application, and other factors such as the level of heat output required from the device.

DETAILED DESCRIPTION OF THE THIRD EMBODIMENT OF THE INVENTION

Figure 5:
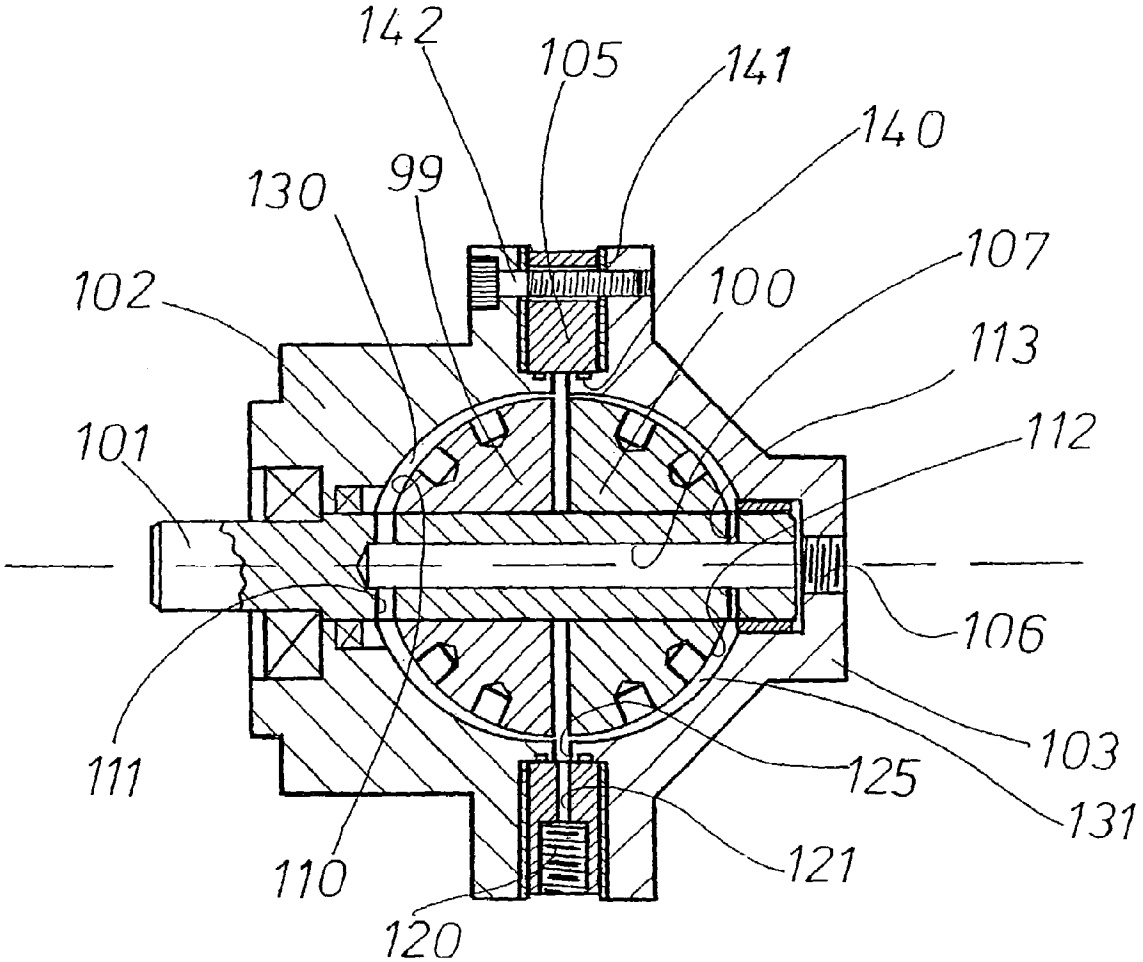
FIG. 5 is a longitudinal sectional view of a device in according to the third embodiment of the present invention.

The device of FIG. 5 employs double hemi-spherical rotors 99, 100, here called a rotor assembly group, where both rotors 99, 100 are preferably driven by a common drive shaft 101 and located inside a housing structure comprising front and rear housing elements 102, 103, and a centrally located sandwich plate 105. The hemi-spherical rotors 99, 100 effectively divide the interior chamber formed by the housing into sub-chambers. Fluid enters the device at inlet 106 and travels through longitudinal hole 107 in drive shaft 101 towards the smaller diameter front-ends 110, 112 of respective rotors 99, 100 by means of respective radial drillings 111, 113 in drive shaft 101. Sandwich plate 105 is provided with fluid exit 120 and passage 121 which communicates with the interior space denoted as 125 which lies radially outwards of rotors 99, 100 and radially inwards of the bore of sandwich plate 105. Fluid entering respective fluid passage gap regions 130, 131 nearest to the smaller diameter ends of rotors 99, 100 travels in a direction towards interior space 125 from where it is expelled from the device via hole 121 and exit 120. In this example, a double static sealing means comprising seal 140 and gasket 141 is employed at respective interfaces between respective housings 102, 103 and the sandwich plate 105, and where a plurality of screws 142 are used to retain the housing structure together. Both inlet 106 and exit 120 are threaded so that standard hydraulic connections can be used to couple the device to pipe work. Cool liquid from some external source enters the heating apparatus at inlet 106 and once heated by the action of the rotating rotor assemblies 99, 100, exhausts at exit 120 in either the form of heated liquid or steam. Although as shown, hemispherical rotor comprise two elements 99, 100, they could, alternatively, be formed in one-piece.

DETAILED DESCRIPTION OF THE FOURTH EMBODIMENT OF THE INVENTION

Figure 7:
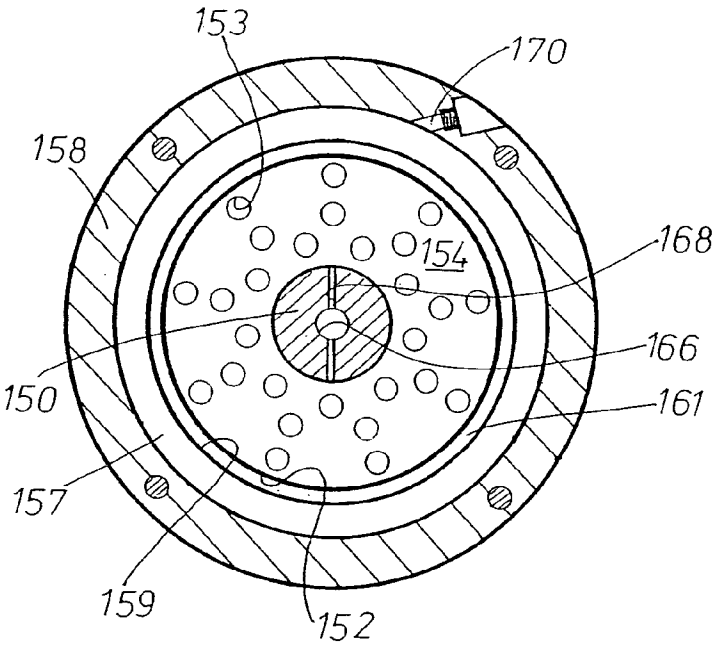
FIG. 7 is a transverse sectional view of the device taken along line III—III in FIG. 6.
Figure 6:
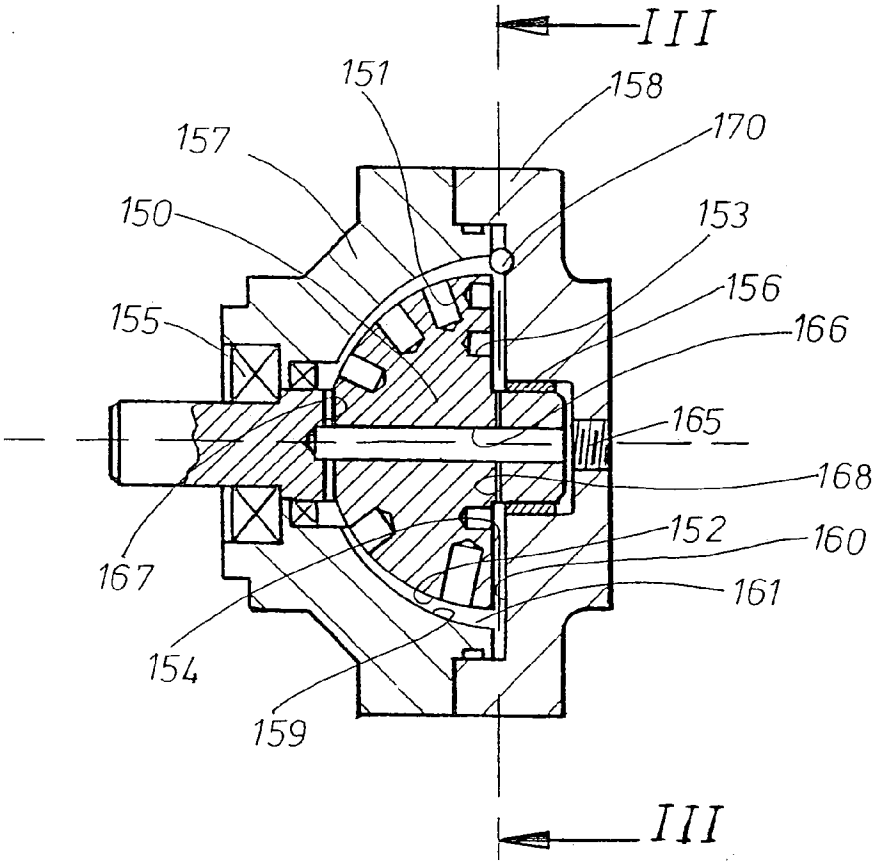
FIG. 6 is a longitudinal sectional view of a device in according to the fourth embodiment of the present invention.

As the device of FIGS. 6 and 7 differs in two main respects from the third embodiment, it is only necessary to describe the important differences.

In this example, the rotor and drive shaft are combined together in one rotational element 150, and where element 150 is provided with a first series of openings 151 over the hemi-spherical shaped portion surface 152 and a second series of openings 153 disposed on end face portion 154. The rotating element 150 is supported by bearings 155, 156 in housing members 157, 158, respectively, and where housings 157, 158 are provided with respective interior surfaces 159, 160 that form an internal chamber 161 occupied by rotatable element 150.

Fluid entering the device at inlet 165 travels through hole 166 in rotatable element 150, and where respective radial holes 167, 168 direct this fluid to the working clearances of the device, namely the first fluid passage gap region formed between interior surface 159 and hemi-spherical shaped rotor portion 152, here called the first fluid passage gap region, and secondly, the second clearance formed between interior surface 160 and end face rotor portion 154, here called the second fluid passage gap region. Preferably radial hole 168 is smaller in size as compared to radial hole 167. The particular advantages of this embodiment over earlier embodiments is that the clearance space by the hemi-spherical shaped portion as well the clearance space by the end face rotor portion are used so that both respective sets of openings 151, 153 can impart heat-generating cavitation to the fluid passing from inlet 165 to exit 170. As shown, the clearances are drawn largely in size than would most often be preferred.

DETAILED DESCRIPTION OF THE FIFTH EMBODIMENT OF THE INVENTION

Figure 8:
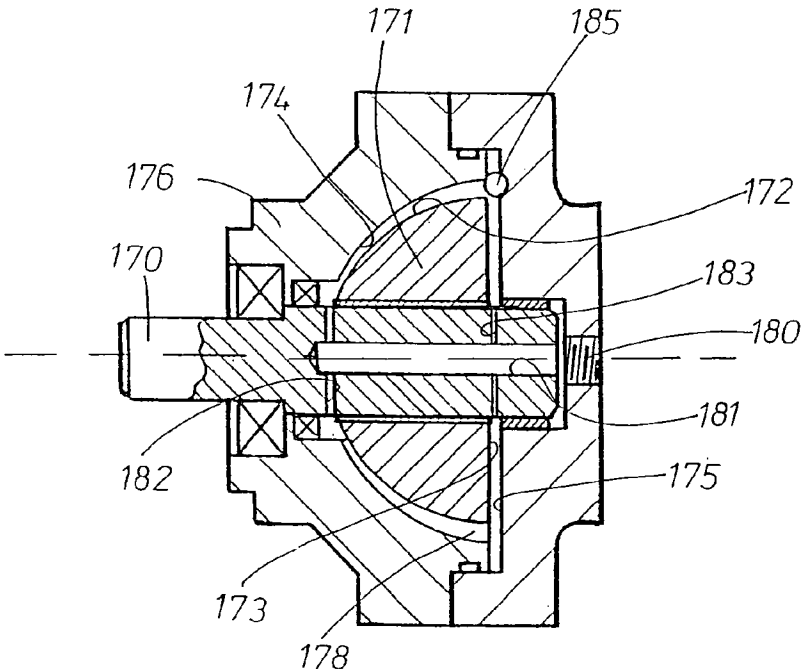
FIG. 8 is a longitudinal sectional view of a device in according to the fifth embodiment of the present invention.

The device in FIG. 8 differs from the fourth embodiment in two major respects, firstly drive shaft 170 and rotor 171 are separate elements fixed together by means of a thread, and secondly, both the hemi-spherical face 172 as well as the back end face 173 of the rotor 171 are of a preferably smooth appearance without incorporating such surface irregularities in the form of openings as incorporated in the earlier embodiments. While earlier embodments of this invention relied principally on the heating effect in the transiting fluid through the phenomena know as cavitation, there would still likely be additional heating in the fluid due to fluid shear.

In this example of the invention, it is in the shearing effect on the fluid as it travels in the fluid passage gap region between the rotating rotor and static housing wall which is entirely relied on to heat up the fluid as it passes throught the device. Preferably, the fluid passage gap region located between the housing interior and the hemi-spherically shaped rotor portion as well as the that fluid passage gap region at the flat end face portion on the opposite side of the rotor can be used to produce the requied heating effect on the fluid.

Interior surfaces 174, 175 of respective housing members 176, 177 form internal chamber 178 occupied by rotor 171, the first fluid passage gap region formed by the space between interior surface 174 and hemi-spherical shaped rotor portion 172, the second fluid passage gap region from by the space between interior surface 175 and end face rotor potrion 173.

Fluid entering the device at inlet 180 travels through hole 181 in rotor, and where respective radial holes 182, 183 direct fluid to the first and second fluid passage gap regions. The heated fluid exits the device at exit 185.

Athough as shown, rotor 171 employs a smooth exterior surface finish and no surface irregularities in the form of openings, additional friction can be introduced by substituting the essentially smooth boundary surfaces with roughened surfaces, for example, by shot penning the outer surface of the rotor and/or the interior surface of the housing.

DETAILED DESCRIPTION OF THE SIXTH EMBODIMENT OF THE INVENTION

Figure 9:
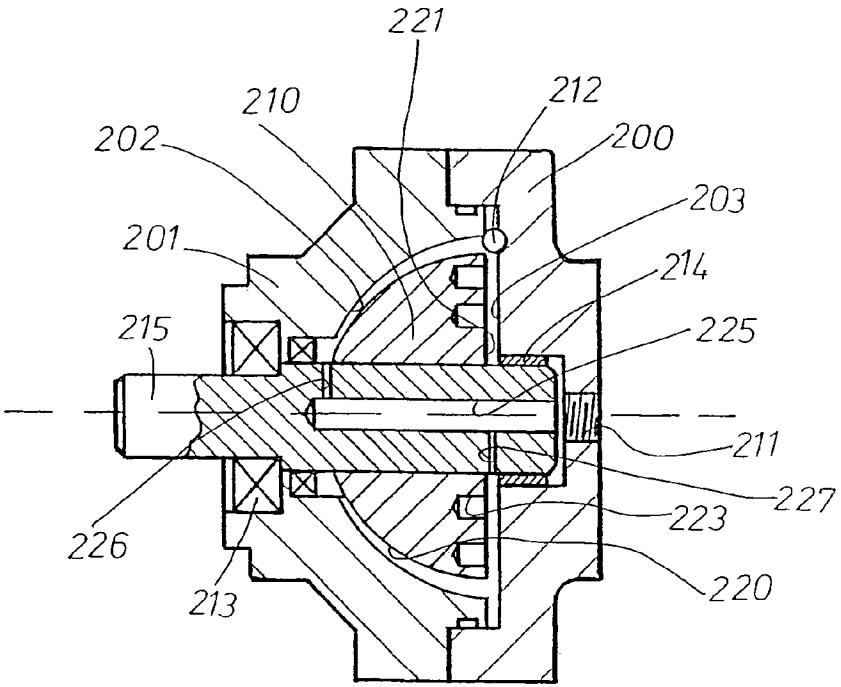
FIG. 9 is a longitudinal sectional view of a device in according to the sixth embodiment of the present invention.

The device of FIG. 9 has a rotor which combines the feature of having a smooth exterior surface over one of its exterior portions and a series of surface irrregularities in the form of openings in the other exterior portion. The device comprises a housing formed, preferably by two members 200, 201, and having respective interior surfaces 202, 203 that form an internal chamber 204 occupied by rotor 210. Housing member 202 is provided with a fluid entry 211 and fluid exit 212, and where a pair of bearings 213, 214 provide support for drive shaft 215. Rotor 210 is fixed to drive shaft 215 to rotate at equal speed. In this example, the hemispherically shaped portion 220 of rotor 210 is smooth in apperance to to impart shearing in the passing fluid whereas the end face portion 221 includes a pluarlity of openings 223 to impart heat-generating cavitation to the passing fluid. Fluid entering the device at inlet 211 travels through hole 225 in drive shaft 215, and where respective radial holes 226, 227 direct this fluid to the fluid passage gap regions of the device, namely the first fluid passage gap region formed between interior surface 202 and hemi-spherical shaped rotor portion 220 and secondly, the second fluid passage gap region formed between interior surface 203 and end face portion 221.

As shown in these varous embodiments, the clearance gap height between the housing interior and the hemi-spherical shaped portion of the rotor can either decrease in size (first embodiment) or increase (other embodiments). However, the various embodiments could also modified to keep the clearance gap height constant, depending on whether a "squeezing" effect on the fluid at some point in its passage from inlet to exit is required. For instance, in the case of a steam generator, there may be an advantage if the gap were to be increased in size towards the larger diameter end of the rotor to take into account the expanding volume of steam.

Although for the purposes of illustrating the various embodiments described in this invention that show hemi-spherical shaped rotors, the term hemi-spherical is intended to cover small modifications in the shape, for example, to one having a bulging hemi-spherical form; or a segment of a sphere. Also as mentioned in the written description for the third embodiment, the combined twin hemispherical rotor configuration could be formed using a single rotor component.

In accordance with the patent statutes, I have described the principles of construction and operation of my invention, and while I have endeavoured to set forth the best embodiments thereof, I desire to have it understood that obvious changes may be made within the scope of the following claims without departing from the spirit of my invention.

What is claimed is:

1. A fluid heating device comprising a housing having an internal chamber and a fluid inlet and a fluid outlet in fluid communication with said internal chamber, said fluid inlet and said fluid outlet each opening exteriorily of said housing; a rotor disposed centrally in said main chamber and mounted for rotation within said chamber about an axis of rotation, said chamber being dimensioned relative to said axis such that the maximum transverse radial distance is greater than the maximum longitudinal distance; said rotor having a plurality of openings formed on at least a face thereof confronting fluid entering said chamber, wherein rotation of said rotor causes said plurality of openings to impart heat-generating cavitation to a fluid entering said chamber, and wherein said chamber is a generally hemi-spherical volume and said rotor is in the form of a hemi-spherical element, said rotor in spaced relation to said housing to provide a passage for fluid to travel from said inlet towards said outlet.

2. The device according to claim 1, wherein said fluid inlet is disposed radially closer to said axis of rotation than said fluid outlet.

3. The device according to claim 1 wherein said plurality of openings comprises plural concentric circular arrays of openings formed on said face.

4. The device according to claim 1 wherein said plurality of openings comprises an irregular array of openings formed on said face.

5. The device according to claim 1 wherein said plurality of openings comprises plural substantially radially-extending rows of openings formed on said face.

6. The device according to claim 1, further comprising a drive shaft for imparting mechanical energy to said rotor, said drive shaft supported in said housing by at least two bearings, one of said at least two bearings being nearer a distal end of said rotor and another of said at least two bearings being nearer the proximate end of said rotor, wherein said drive shaft is provided with a fluid passageway, said fluid passageway connecting said inlet with said chamber.

7. The device according to claim 1, further comprising a rotor assembly comprising said rotor together with at least one additional rotor mounted for rotation therewith, said at least one additional rotor comprising a plurality of cavitation-inducing openings formed therein, said rotor and said at least one additional rotor being axially spaced apart from one another to define a subchamber within said chamber.

8. A fluid heating device comprising a housing having an internal chamber and a fluid inlet and a fluid outlet in fluid communication with said internal chamber, said fluid inlet and said fluid outlet each opening exteriorily of said housing; a rotor disposed centrally in said main chamber and mounted for rotation within said chamber about an axis of rotation, said chamber being dimensioned relative to said axis such that the maximum transverse radial distance is greater than the maximum longitudinal distance; said rotor having a face thereof confronting fluid entering said chamber, wherein rotation of said rotor causes said face to impart heatgenerating turbulence and shearing to a fluid entering said chamber, and wherein said chamber is a generally hemi-spherical volume and said rotor is in the form of a hemi-spherical element, said rotor in spaced relation to said housing to provide a passage for fluid to travel from said inlet towards said outlet.

9. The device according to claim 8, wherein said fluid inlet is disposed radially closer to said axis of rotation than said fluid outlet.

10. The device according to claim 8, further comprising a drive shaft for imparting mechanical energy to said rotor, said drive shaft supported in said housing by at least two bearings, one of said at least two bearings being nearer a distal end of said rotor and another of said at least two bearings being nearer the proximate end of said rotor, wherein said drive shaft is provided with a fluid passageway, said fluid passageway connecting said inlet with said chamber.

11. A fluid heating device comprising a housing having an internal chamber and a fluid inlet and a fluid outlet in fluid communication with said chamber, said fluid inlet and said fluid outlet each opening exteriorily of said housing; a rotor mounted for rotation within said chamber about an axis of rotation, said chamber being dimensioned relative to said axis such that the maximum transverse radial distance is greater than the maximum longitudinal distance, said rotor disposed centrally in said chamber in spaced relation to said housing and dividing said chamber into first and second fluid passage gap regions, wherein rotation of said rotor causes fluid entering said inlet to be displaced into at least one of said first and second fluid passage gap regions, and wherein said chamber is a generally hemi-spherical volume and said rotor is in the form of a hemi-spherical element.

12. The device according to claim 11, wherein said rotor includes a plurality of openings formed on at least a face thereof to impart heat-generating cavitation to the fluid in at least one of said first and second fluid passage gap regions.

13. The device according to claim 11, wherein said rotor includes on at least a face thereof a generally smooth appearance devoid of any surface irregularities.

14. The device according to claim 11, wherein said fluid inlet is disposed radially closer to said axis of rotation than said fluid outlet.

15. The device according to claim 11, further comprising a drive shaft for imparting mechanical energy to said rotor, said drive shaft provided with a fluid passageway, said fluid passageway connecting said inlet with at least one of said first and second fluid passage gap regions.

16. A method of heating fluids, comprising causing a fluid to enter an inlet of a device comprising a housing having an internal chamber, a rotor mounted for rotation within said chamber about an axis of rotation, said inlet passage and an outlet each opening exteriorly of said housing, and said inlet being disposed radially closer to said axis of rotation than said outlet, said rotor having a plurality of openings formed on a face thereof confronting fluid entering said chamber, while rotating said rotor at a speed sufficient to cause said plurality of openings to impart heatgenerating cavitation to a fluid entering said chamber, and wherein said device further comprises a rotor assembly comprising said rotor together with at least one additional rotor mounted for rotation therewith, said at least one additional rotor comprising a plurality of cavitation-inducing openings formed therein, said rotor and said at least one additional rotor being axially spaced apart from one another to define a subchamber within said chamber, and wherein said method further comprising causing said fluid to enter said subchamber while rotating said rotor assembly.

* * * * *